US006124804A

United States Patent [19]

Kitao et al.

[11] Patent Number: 6,124,804

[45] **Date of Patent: *Sep. 26, 2000**

[54] REMOTE CONTROLLER, REMOTE CONTROL INTERFACE, AND REMOTE CONTROL SYSTEM INCLUDING A REMOTE CONTROLLER AND A REMOTE CONTROL INTERFACE

[75] Inventors: Mitsuru Kitao, Yamatokoriyama; Mitsujiro Matsumoto, Takatsuki; Toshihisa Ikeda, Kyoto; Toshihiko Kurosaki; Minoru Nishioka, both of Kobe; Toshiaki Mori, Mino, all of Japan

[73] Assignee: Matsushita Electric Industrial Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/554,516

[22] Filed: Nov. 7, 1995

[30] Foreign Application Priority Data

Nov. 10, 1994 [JP] Japan ..... 6-276445
Nov. 22, 1994 [JP] Japan ..... 6-287845

[51] Int. Cl.[7] ..... G08C 19/00

[52] U.S. Cl. ..... 340/825.69; 348/734; 359/142; 340/825.72; 379/102

[58] Field of Search ..... 340/825.69, 823.54, 340/825.76, 825.83, 825.52, 825.22, 825.57, 825.24, 825.25; 348/734; 359/142, 145, 146, 148

[56] References Cited

U.S. PATENT DOCUMENTS 4,623,887 11/1986 Welles ..... 340/825.57
4,728,949 3/1988 Platte et al. ..... 340/825.37
4,764,981 8/1988 Miyahara et al. ..... 455/603

(List continued on next page.)

FOREIGN PATENT DOCUMENTS 60-184382 12/1985 Japan .
64-56000 3/1989 Japan .
0172792 5/1989 Japan .

(List continued on next page.)

OTHER PUBLICATIONS

Office Actions dated Jun. 9 and Dec. 15, 1998, issued in Japanese Patent Application No. 5–281016; (Partial translation of Japanese Office Action dated Dec. 15, 1998 showing the relevancy of the cited references as asserted by the Examiner.

*Primary Examiner*—Michael Horabik
*Assistant Examiner*—Anthony A. Asongwed
*Attorney, Agent, or Firm*—Renner, Otto, Boisselle & Sklar LLP

[57] ABSTRACT

A remote control system for controlling an electronic device includes a remote controller and a remote control interface. The remote controller includes a memory for storing a plurality of control data respectively indicating the relationship between a plurality of control signals and functions of the electronic device corresponding to the plurality of control signals; a trigger signal transmitter for transmitting a trigger signal for causing the electronic device to transmit a response signal which is specific to the type of the electronic device; a receiver for receiving the response signal; and a control signal transmitter for selecting control data specific to the type of the electronic device from the plurality of control data based on the response signal, generating one of the control signals, and transmitting the generated control signal. The remote control interface includes a receiver for receiving a signal transmitted from the remote controller; a signal generator for generating the response signal specific to the type of the electronic device; and a transmitter for, when the signal is a control signal, transmitting the control signal to the electronic device, and for, when the signal is a trigger signal demanding the response signal, transmitting the response signal to the remote controller.

14 Claims, 8 Drawing Sheets

U.S. PATENT DOCUMENTS

| | | | |
|---|---|---|---|
| 5,028,919 | 7/1991 | Hidaka . | |
| 5,227,780 | 7/1993 | Tigwell | 340/825.72 |
| 5,646,608 | 7/1997 | Shintani | 340/825.52 |
| 5,726,645 | 3/1998 | Kaman et al. | 340/825.22 |

FOREIGN PATENT DOCUMENTS

| | | |
|---|---|---|
| 1115298 | 5/1989 | Japan . |
| 29300 | 1/1990 | Japan . |
| 2257795 | 10/1990 | Japan . |
| 2276397 | 11/1990 | Japan . |
| 0438193 | 3/1992 | Japan . |
| 4160896 | 6/1992 | Japan . |
| 4167897 | 6/1992 | Japan . |
| 4267696 | 9/1992 | Japan . |
| 0550891 | 7/1993 | Japan . |
| 2255430 | 2/1992 | United Kingdom . |

REMOTE CONTROLLER, REMOTE CONTROL INTERFACE, AND REMOTE CONTROL SYSTEM INCLUDING A REMOTE CONTROLLER AND A REMOTE CONTROL INTERFACE

BACKGROUND OF THE INVENTION

1. Field of the Invention

The present invention relates to a remote controller, a remote control interface, and a remote control system including a remote controller and a remote control interface which can be used commonly for a plurality of different types of electronic devices.

2. Description of the Related Art

One known conventional remote control system is a "learning remote controller", which is disclosed in, for example, U.S. Pat. No. 4,623,887.

Such a learning remote control system operates in the following manner.

A conventional learning remote control system operates in two modes, namely, a learning mode and a control mode. In the learning mode, the learning remote control system receives a signal indicating a control code (for example, modulated infrared light) from a remote controller specifically produced for an electronic device to be controlled. For instance, when a "power ON" key of the specific remote controller is pressed, a signal including a control code which commands "power ON" is transmitted to the learning remote control system from the remote controller produced for a specific electronic device. The learning remote control system receives the signal and stores the code therein. Such an operation is performed for each of keys of the electronic device to store the control codes in the learning remote control system.

In the control mode, when the "power ON" key of the learning remote control system is pressed, the control code for "power ON" is read and then transmitted to the electronic device. In this manner, the electronic device is controlled.

Such a learning remote control system has a problem in that the learning procedure needs to be performed for each of electronic devices to be controlled, which requires complicated processes, much trouble and time.

SUMMARY OF THE INVENTION

In an aspect of the present invention, a remote controller for controlling an electronic device includes a memory for storing a plurality of control data respectively indicating the relationship between a plurality of control signals and functions of the electronic device corresponding to the plurality of control signals; a trigger signal transmitter for transmitting a trigger signal for causing the electronic device to transmit a response signal which is specific to the type of the electronic device; a receiver for receiving the response signal; and a control signal transmitter for selecting control data specific to the type of the electronic device from the plurality of control data based on the response signal, generating one of the control signals, and transmitting the generated control signal.

In another aspect of the present invention, a remote controller for controlling an electronic device includes a trigger signal transmitter for transmitting a trigger signal for causing the electronic device to transmit a response signal which includes a plurality of control data respectively indicating the relationship between a plurality of control signals and functions of the electronic device corresponding to the plurality of control signals; a receiver for receiving the response signal; a memory for storing the plurality of control data retrieved from the response signal; and a control signal transmitter for generating one of the control signals based on the plurality of control data stored in the memory and transmitting the generated control signal to the electronic device.

In still another aspect of the present invention, a remote control interface for receiving a control signal transmitted from a remote controller and transmitting the control signal to an electronic device includes a receiver for receiving a signal transmitted from the remote controller; a signal generator for generating a response signal specific to the type of the electronic device; and a transmitter for, when the signal is a control signal, transmitting the control signal to the electronic device, and for, when the signal is a trigger signal demanding the response signal, transmitting the response signal to the remote controller.

In still another aspect of the present invention, a remote control interface for receiving a control signal transmitted from a remote controller and transmitting the control signal to an electronic device includes a receiver for receiving a signal transmitted from the remote controller; a memory for storing a plurality of control data each indicating the relationship between a plurality of control signals and functions of the electronic device corresponding to the plurality of control signals; a transmitter for, when the signal is a control signal, transmitting the control signal to the electronic device, and for, when the signal is a trigger signal demanding the plurality of control data, transmitting a response signal including the plurality of control data to the remote controller.

In still another aspect of the present invention, in a remote control system for controlling an electronic device including a remote controller and a remote control interface, the remote controller includes a memory for storing a plurality of control data respectively indicating the relationship between a plurality of control signals and functions of the electronic device corresponding to the plurality of control signals; a trigger signal transmitter for transmitting a trigger signal for causing the electronic device to transmit a response signal which is specific to the type of the electronic device; a receiver for receiving the response signal; and a control signal transmitter for selecting control data specific to the type of the electronic device from the plurality of control data based on the response signal, generating one of the control signals, and transmitting the generated control signal. The remote control interface includes a receiver for receiving a signal transmitted from the remote controller; a signal generator for generating the response signal specific to the type of the electronic device; and a transmitter for, when the signal is a control signal, transmitting the control signal to the electronic device, and for, when the signal is a trigger signal demanding the response signal, transmitting the response signal to the remote controller.

In still another aspect of the present invention, in a remote control system for controlling an electronic device including a remote controller and a remote control interface, the remote controller includes a trigger signal transmitter for transmitting a trigger signal for causing the electronic device to transmit a response signal which includes a plurality of control data respectively indicating the relationship between a plurality of control signals and functions of the electronic device corresponding to the plurality of control signals; a receiver for receiving the response signal; a memory for storing the plurality of control data retrieved from the response signal; and a control signal transmitter for generating one of the control signals based on the plurality of control data stored in the memory and transmitting the generated control signal to the electronic device. The remote control interface includes a receiver for receiving a signal transmitted from the remote controller; a memory for storing the plurality of control data each indicating the relationship between the plurality of control signals and the functions of the electronic device corresponding to the plurality of control signals; and a transmitter for, when the signal is a control signal, transmitting the control signal to the electronic device, and for, when the signal is a trigger signal demanding the plurality of control data, transmitting the response signal including the plurality of control data to the remote controller.

According to the present invention, the electronic device which receives a selection signal (trigger signal) from a remote controller sends a signal identifying the type of the electronic device back to the remote controller. Due to such a structure, the electronic device to be controlled can be selected immediately merely by performing a simple key operation while the remote controller is directed to the electronic device. A "Learning" process using a remote controller specifically produced for that electronic device is not necessary. In the case where the control code tables corresponding to various electronic devices are built in the remote controller, the selected electronic device can be controlled merely by retrieving the control code table corresponding to the selected electronic device. The same effect is obtained by transmitting the control code table itself from the electronic device to the remote controller. Thus, various types of electronic devices can be controlled by a compact common remote controller.

Also according to the present invention, an element is provided in the electronic device for showing that the electronic device has been selected. Thus, the user can easily confirm that the desired electronic device has been accurately selected. In the case where the remote controller includes an element which shows from which electronic device a response signal has been received, the desired electronic device can be accurately selected even when a plurality of electronic devices located close to one another each send the response signals back to the remote controller. Thus, erroneous operation such as operating an undesired electronic device can be avoided. In combination with the above-described element in the electronic device, the desired electronic device can be controlled easily and reliably. Further, since a signal having a higher directivity is used as the selection signal, not as the control signal, the desired electronic device can be selected more reliably.

Thus, the invention described herein makes possible the advantage of providing a remote controller, a remote control interface, and a remote control system including a remote controller and a remote control interface, for easily controlling a desired electronic device merely by conducting simple key operation in the state where the remote controller is directed toward the desired electronic device.

This and other advantages of the present invention will become apparent to those skilled in the art upon reading and understanding the following detailed description with reference to the accompanying figures.

DESCRIPTION OF THE PREFERRED EMBODIMENTS

EXAMPLE 1

Figure 1:
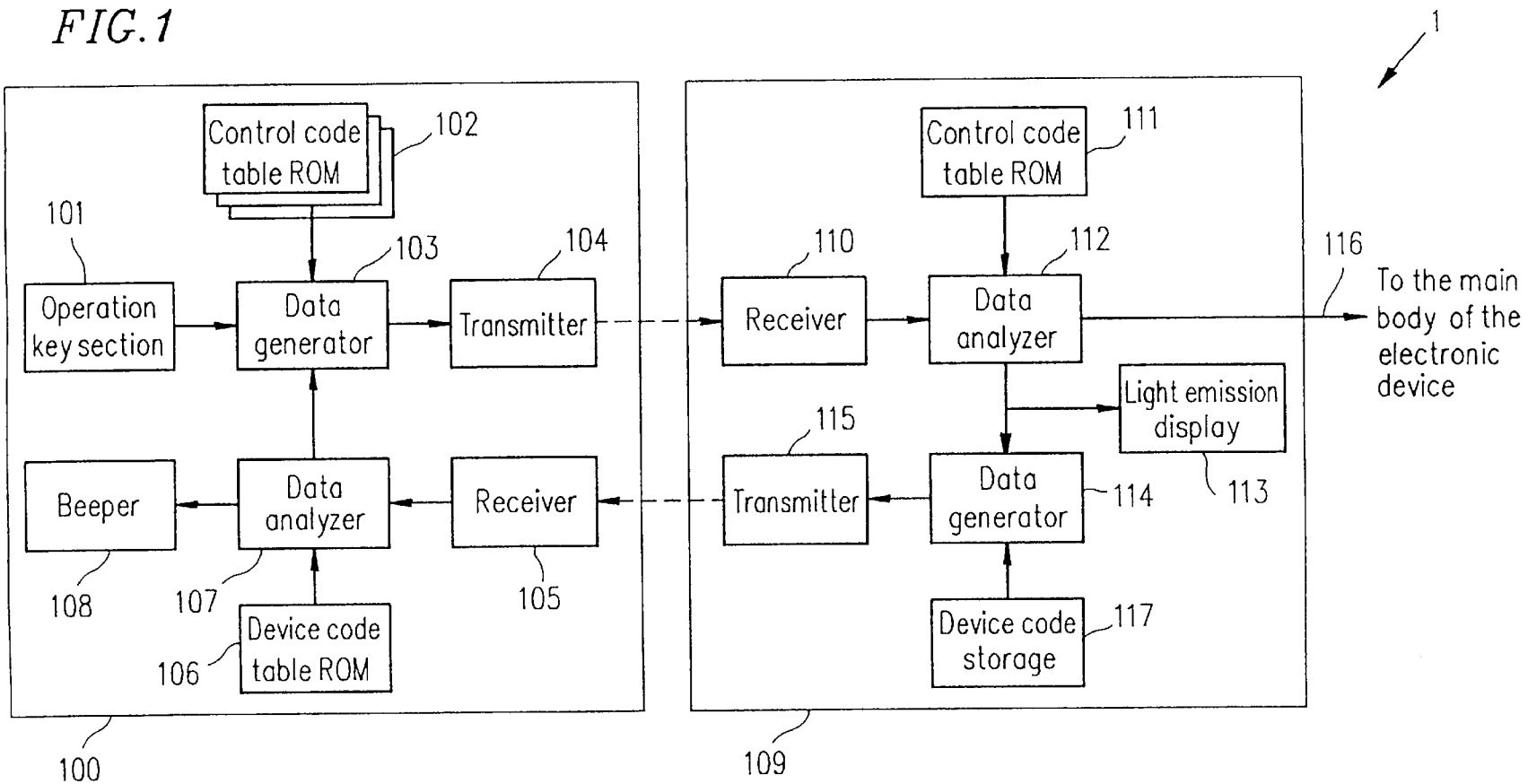
FIG. 1 is a block diagram of a remote control system in a first example according to the present invention.

FIG. 1 is a block diagram of a remote control system 1 in a first example according to the present invention.

As is shown in FIG. 1, the remote control system 1, for controlling an electronic device, includes a remote controller 100 and a remote control interface 109 electrically connected to the electronic device. The electronic device can be any type of device which can function upon receiving a control signal from the remote control interface 109, for example, a TV or a video cassette recorder (hereinafter, referred to as a "VCR"). In this specification, "function" means, for example, "power ON" or "play" in a VCR.

The remote control system 1 generally operates in the following manner.

The remote controller 100 includes an operation key section 101 including a selection key. A user presses a selection key to select an electronic device to be controlled while infrared light emitted from a transmitter 104 in the remote controller 100 is directed toward the electronic device. When the selection key is pressed, a trigger signal which demands specific information regarding the electronic device (hereinafter, referred to as a "device code") is transmitted to the electronic device. The specific information includes at least one of a category of the electronic device (namely, whether the electronic device is a TV, a VCR, or an air conditioner), the name of the manufacturer, the time of manufacture, the manufacturing version, and the lot number. The trigger signal is first transmitted from the remote controller 100 to the remote control interface 109 in a wireless state, namely, by a carrier wave such as infrared light, an electric wave, or the like. For example, the infrared light which is already modulated by a prescribed frequency is further modulated by a trigger signal to be transmitted to the remote control interface 109.

The remote control interface 109 identifies the trigger signal included in the carrier wave and then sends the device code back to the remote controller 100. The device code is also spatially transmitted by a carrier wave.

Upon receiving the carrier wave including the device code, the remote controller 100 selects, based on the device code, one control code table corresponding to the selected electronic device from a plurality of control code tables. Each control code table has a data stored therein indicating functions of the electronic device and the control codes for activating the respective functions.

The operation key section 101 has function keys indicating various functions of electronic devices in addition to the selection key. After selecting the electronic device to be controlled, the user presses a key to select a desired function. Then, a control code to activate the selected function is retrieved from the control code table selected based on the device code. The remote controller 100 transmits the retrieved control code to the remote control interface 109 by a carrier wave.

Upon receiving the carrier wave including the control code, the remote control interface 109 restores the control code from the carrier wave, and then sends a control signal 116 to the electronic device. The electronic device activates the function selected by the user according to the control signal 116.

As is described above, the remote control system according to the present invention transmits a control code to the electronic device substantially in the following three steps (1) an electronic device to be controlled is selected; (2) the remote control interface 109 sends a device code to the remote controller 100; and (3) a control code table is selected based on the device code, and a control code corresponding to the function to be activated is sent to the remote control interface 109. A remote control system according to the present invention is used for controlling a plurality of electronic devices using trigger signals of a common format, and thus generation of different trigger signals for different electronic devices is not required. In the case where the plurality of electronic devices are placed in an area which the carrier wave from the remote controller 100 reaches, the remote controller 100 needs to send a trigger signal with a certain level of directivity so as to be received by only the electronic device to be controlled.

Hereinafter, each of the various parts of the remote control system 1 will be described in detail.

The operating key section 101 includes a selection key and function keys. Only one selection key is necessary since trigger signals of a common format are used for a plurality of electronic devices. When the selection key is pressed, the operation key section 101 sends data to a data generator 103 indicating that the selection key has been pressed.

Upon receiving such data, the data generator 103 generates data indicating a trigger signal of the common format (hereinafter, referred to as "trigger data"). The trigger data can be any type of data which can be distinguished from the control code. The trigger data can be, for example, consecutive bits "1". The trigger data is stored in a memory (not shown) in the data generator 103, but can be stored in other areas. For example, the trigger data can be retrieved from a memory area of an arbitrary control code table in the control code table ROM 102, which stores a plurality of control code tables respectively corresponding to a plurality of electronic devices. The control code tables are stored in the ROM in this example, but can be stored in any device which can store data. In the case where the trigger data is stored in a prescribed location of each of the plurality of control code tables, the trigger data can be generated using any of the plurality of control code tables.

The trigger data generated by the data generator 103 is sent to the transmitter 104. The format of the trigger signal formed based on the trigger data and the format of the control signal formed based on the control code are appropriately determined based on the carrier wave, the type of remote controller 100, the type of the remote control interface 109, the distance between the remote controller 100 and the remote control interface 109, and the like. If necessary, a redundant check bit can be added to the trigger data and the control code to prepare for a transmission error.

The transmitter 104 generates a trigger signal by modulating the carrier wave (infrared light in this example) using the trigger data, and then transmits the trigger signal to the remote control interface 109 by infrared light emitted from an LED (light emitting diode; not shown). The LED preferably emits infrared light with an appropriate level of directivity so that the trigger signal can be transmitted only to the electronic device to be controlled when the user presses the selection key in the state where the LED is directed to the device to be controlled.

A receiver 110 in the remote control interface 109 for receiving the infrared light includes a photodiode which is sensitive to infrared light and a demodulator (neither is shown). The receiver 110 receives the modulated infrared light by the photodiode and demodulates the infrared light to generate data indicating the trigger signal, and then sends the trigger signal to a data analyzer 112. A control code table ROM 111 in the remote control interface 109 has trigger data or data indicating a feature of the trigger data stored therein.

The data analyzer 112 analyzes the demodulated data by comparing the demodulated data and the trigger data stored in the control code table ROM 111 to determine whether the signal received is a trigger signal or a control signal. Alternatively, the determination is performed based on the data indicating the feature of the trigger data, for example, the number of consecutive bits "1".

If the signal received is a trigger signal, the data analyzer 112 commands a data generator 114 to send the device code to the remote controller 100. The data analyzer 112 also commands a light emission display 113 to turn on an LED emitting visible light for a certain period of time in order to visually show the user that the trigger signal has been received. The light emission display 113 uses an LED in this example but can be a liquid crystal display installed in the main body of the electronic device.

Upon the receipt of the command from the data analyzer 112, the data generator 114 retrieves the device code from a device code storage 117, generates transmission data including the device code, and then sends the transmission data to a transmitter 115 in the remote control interface 109. The device code storate 117 can be an independent memory or a part of the control code table ROM 111. The transmitter 115 modulates the infrared light used as a carrier wave by the transmission data and drives the LED to emit the infrared light as a response signal including the device code.

A receiver 105 in the remote controller 100, which operates in the same manner as the receiver 110, receives the response signal, restores the device code, and then sends the device code to a data analyzer 107 in the remote controller 100. A device code table ROM 106 has device codes of a plurality of electronic devices stored therein. The data analyzer 107 generates table selection data based on the device code received and the device codes stored in the device code table ROM 106, and sends the table selection data to the data generator 103. The data generator 103 uses the table selection data to select, among a plurality of control code tables stored in the control code table ROM 102, a control code table used for the electronic device indicated by the device code received.

If the response signal is not received within a prescribed period of time, the data analyzer 107 performs error processing. For example, the data analyzer 107 turns on a beeper 108 to urge the user to press the selection key again. An error can occur when, for example, the waveform of the response signal is not reproduced correctly due to other response signals indicating the device codes of other electronic devices which are also received.

After this, in order to activate a function of the same electronic device, the above-selected control code table is used. In order to select a different electronic device, the selection key needs to be pushed again.

When the light emission display 113 emits light, the user presses one of the function keys on the operation key section 101. The data generator 103 generates a control code based on the data of the function key which has been pressed and the above-selected control code table. The control code table defines the relationship between the functions of the electronic device and control codes which are to be sent to the electronic device in order to activate the respective functions. For example, the control code table which is selected when the VCR is selected has a control code for turning the "power ON", a control code activating "play", a control code for activating timer recording, and the like. In the case when the user presses the "play" function key after selecting the VCR, the data generator 103 retrieves the control code for activating "play" from the control code table and sends that control code to the transmitter 104.

Upon receiving the control code, the transmitter 104 transmits the control code to the remote control interface 109 in the form of infrared light. The receiver 110 demodulates the infrared light to restore the control code (for "play" in this example) and sends the control code to the data analyzer 112 in the same manner as processing the trigger signal. The data analyzer 112 analyzes the control code based on the control code table from the control code table ROM 111 to generate a control output 116, which is sent to the main body of the electronic device. The control output 116 can be any type of signal which can activate the selected function. In the case where, for example, the electronic device has an intelligent controller, the remote control interface 109 can send the control output 116 through a data bus without decoding the control code. In the case where the electronic device does not have a controller, the control output 116 can be sent to the electronic device by a single signal line for activating the function.

As is described above, the remote controller 100 of the remote control system according to the present invention receives a signal indicating the specific information of the electronic device to be controlled through the remote control interface 109. Due to such a structure, control signals corresponding to various electronic devices can be received without "learning", as is necessary in the conventional remote control system.

According to the present invention, the remote controller 100 and the remote control interface 109 can inform the user of the current situation by light and sound based on the conditions of the trigger signal and the control signal. The user can be informed by light and sound as to whether or not the electronic device has been correctly selected, whether or not the device code has been obtained, and the like. As a result, wrong selection of the electronic device and wrong operation can be avoided.

EXAMPLE 2

Figure 2:
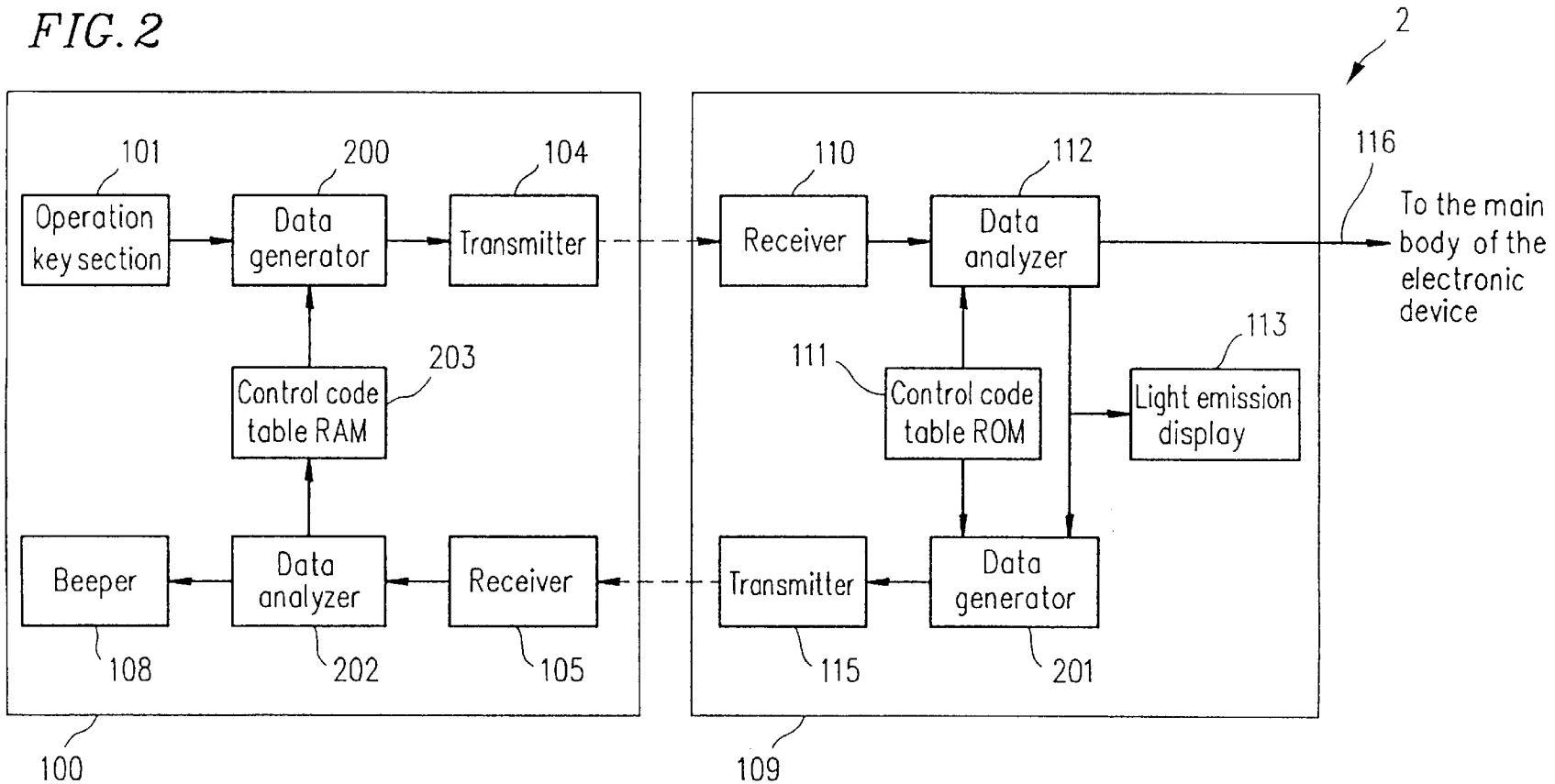
FIG. 2 is a block diagram of a remote control system in a second example according to the present invention.

FIG. 2 is a block diagram of a remote control system 2 in a second example according to the present invention. In this and the following examples, identical elements with those in the first example bear the same reference numerals therewith, and detailed explanation thereof will be omitted.

The remote control system 2 operates in the following manner.

The user presses the selection key to select an electronic device to be controlled. Upon receipt of the data indicating the selection key has been pressed, a data generator 200 generates and sends trigger data to the transmitter 104. The trigger data is stored in a memory (not shown) of the data generator 200. The transmitter 104 modulates infrared light by the trigger data to form a trigger signal and transmits the trigger signal to the remote control interface 109.

Upon receipt of the trigger signal, the receiver 110 in the remote control interface 109 demodulates the trigger signal to restore the trigger data and sends the data to the data analyzer 112. The data analyzer 112 determines whether the signal received is a trigger signal or a control signal based on the data received and the data stored in the control code table ROM 111. If the signal received is a trigger signal, the data analyzer 112 commands a data generator 201 to down-load the control code table stored in the control code table ROM 111.

The data generator 201 retrieves data defining the control code table of the electronic device from the control code table ROM 111 and sends the data to a transmitter 115. The transmitter 115 modulates the infrared light by the data defining the control code table and transmits the data to the remote controller 100 as a response signal.

Upon receipt of the response signal, the receiver 105 in the remote controller 100 restores the data defining the control code table from the response signal and then sends the data to a data analyzer 202 in the remote controller 100. The data analyzer 202 writes the control code table into a control code table RAM 203. The control code table is written in the RAM in this example, but can written in any rewritable memory.

When the user presses a function key after selecting the electronic device, the data generator 200 reads a control code for activating the selected function from the control code table RAM 203 and sends the control code to the transmitter 104. After the transmitter 104 receives the control code, the remote control system 2 operates in the same manner as the remote control system 1 in the first example.

The remote control system 2 operates in the same manner as the remote control system 1 except for the above-described points.

In the first example, a plurality of control code tables which define the relationship between functions of a plurality of electronic devices and control codes for activating the respective functions are stored in the control code table ROM 102 in the remote controller 100. In the second example, the remote controller 100 down-loads a control code table from the electronic device and stores the table in a built-in memory of the remote controller 100. Such a structure eliminates the necessity of storing control code tables of many electronic devices in a memory of the remote controller 100 in advance. Accordingly, the remote controller 100 does not require a large memory in order to control many types of electronic devices. Even if a new electronic device adopts a new control code table, the remote controller 100 can down-load the control code table from the new electronic device. Thus, the remote control system 2 can be used even for a new electronic device.

EXAMPLE 3

Figure 3:
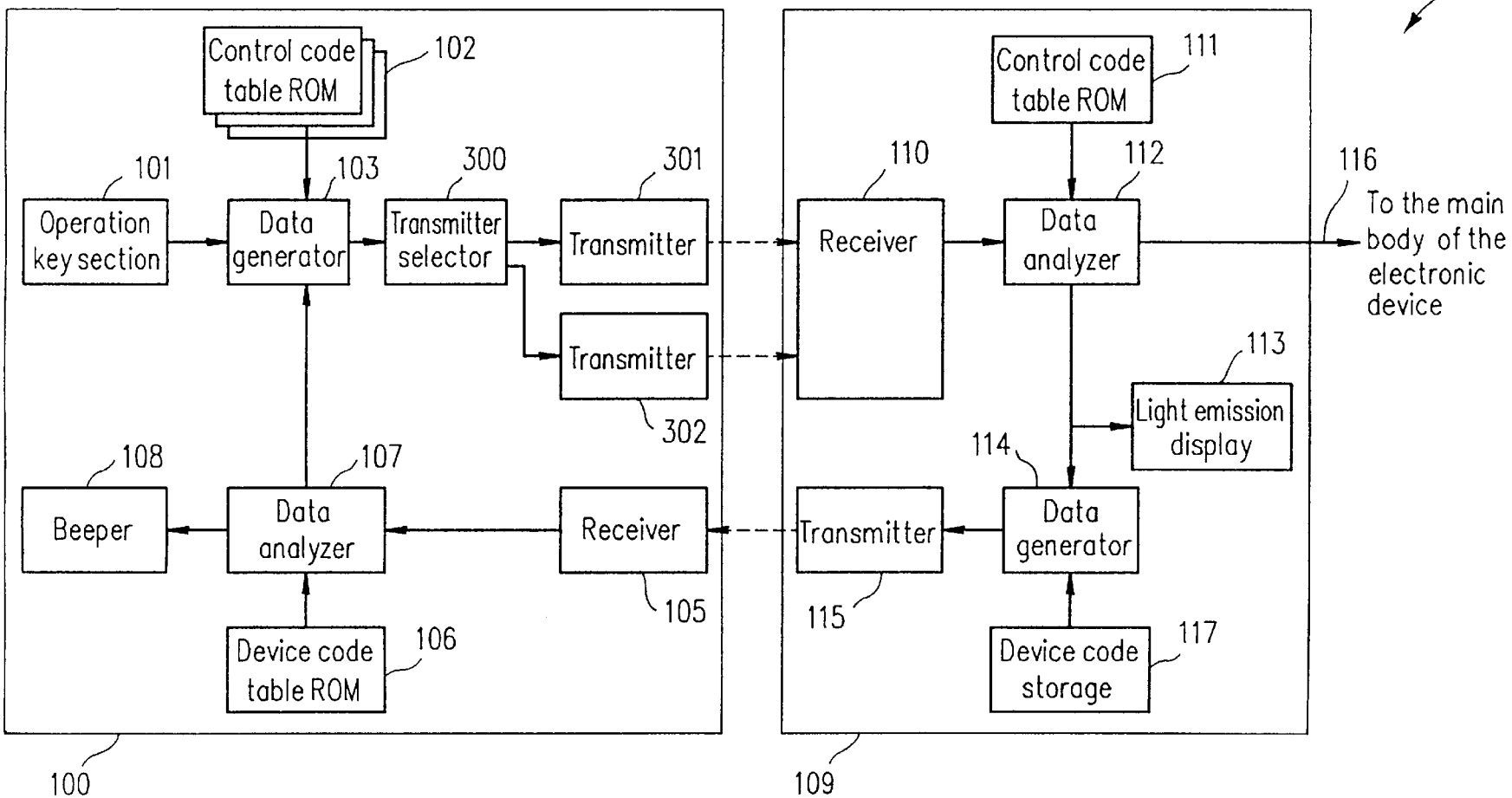
FIG. 3 is a block diagram of a remote control system in a third example according to the present invention.

FIG. 3 is a block diagram of a remote control system 3 in a third example according to the present invention.

The remote control system 3 is different from the remote control system 1 in that the remote controller 100 of the remote control system 3 includes two transmitters 301 and 302, one of which is used in accordance with whether a trigger signal or a control signal is to be sent from the remote controller 100.

In more detail, a data generator 103 sends trigger data or a control code to a transmitter selector 300, and the transmitter selector 300 sends the trigger data to the transmitter 301 and sends the control code to the transmitter 302.

The transmitter 301 for transmitting a trigger signal has a narrower directivity than the transmitter 302 so that one of a plurality of electronic devices can be easily selected. The transmitter 302 for transmitting a control code after an electronic device is selected can have a relatively wide directivity. In this specification, "directivity" means the degree to which light emitted from the LED diffuses. A "narrow directivity" means that the light emitted by the LED is difficult to diffuse. By appropriately setting the directivity of the transmitters 301 and 302, it is not necessary to direct the remote controller 100 to the remote control interface 109 of the electronic device for sending a control code as precisely as for sending a trigger signal.

In order to set different directivities for the two transmitters 301 and 302, infrared LEDs having different directivities are, for example, used for the transmitters 301 and 302. The directivity of an LED depends on the shape of the package. LEDs are commercially available with various directivities.

In the third example, two transmitters 301 and 302 are switched over to transmit infrared light to the remote control interface 109 with different directivities. Alternatively, a single transmitter and a directivity controller can be used. A directivity controller changes the directivity of infrared light emitted by a single transmitter. For example, the directivity can be changed by changing the distance between the LED and a light collector (for example, a convex lens) which is provided on the path of the light emitted by the LED, by the directivity controller.

Even only with a single transmitter, the directivity can be changed by changing the amount of the current flowing in the LED. A smaller amount of current is used for transmitting a trigger signal than for transmitting a control signal. By such a difference in the amount of current, the range of angles in which the remoted control interface 109 can obtain sufficient light to receive a trigger signal is more restricted than the range for a control signal. In other words, even if the profiles of the directivities are analogous in shape but different in size, the range of angles that the infrared light can reach is changed. Thus, the directivity is virtually changed.

Still alternatively, the remote control interface 109 can have a plurality of receivers having different directivities. For example, the remote control interface 109 can include a receiver for receiving a trigger signal from the transmitter 301 and another receiver for receiving a control signal from the transmitter 302. In all the above-mentioned alternatives, the same effect is obtained.

EXAMPLE 4

Figure 4:
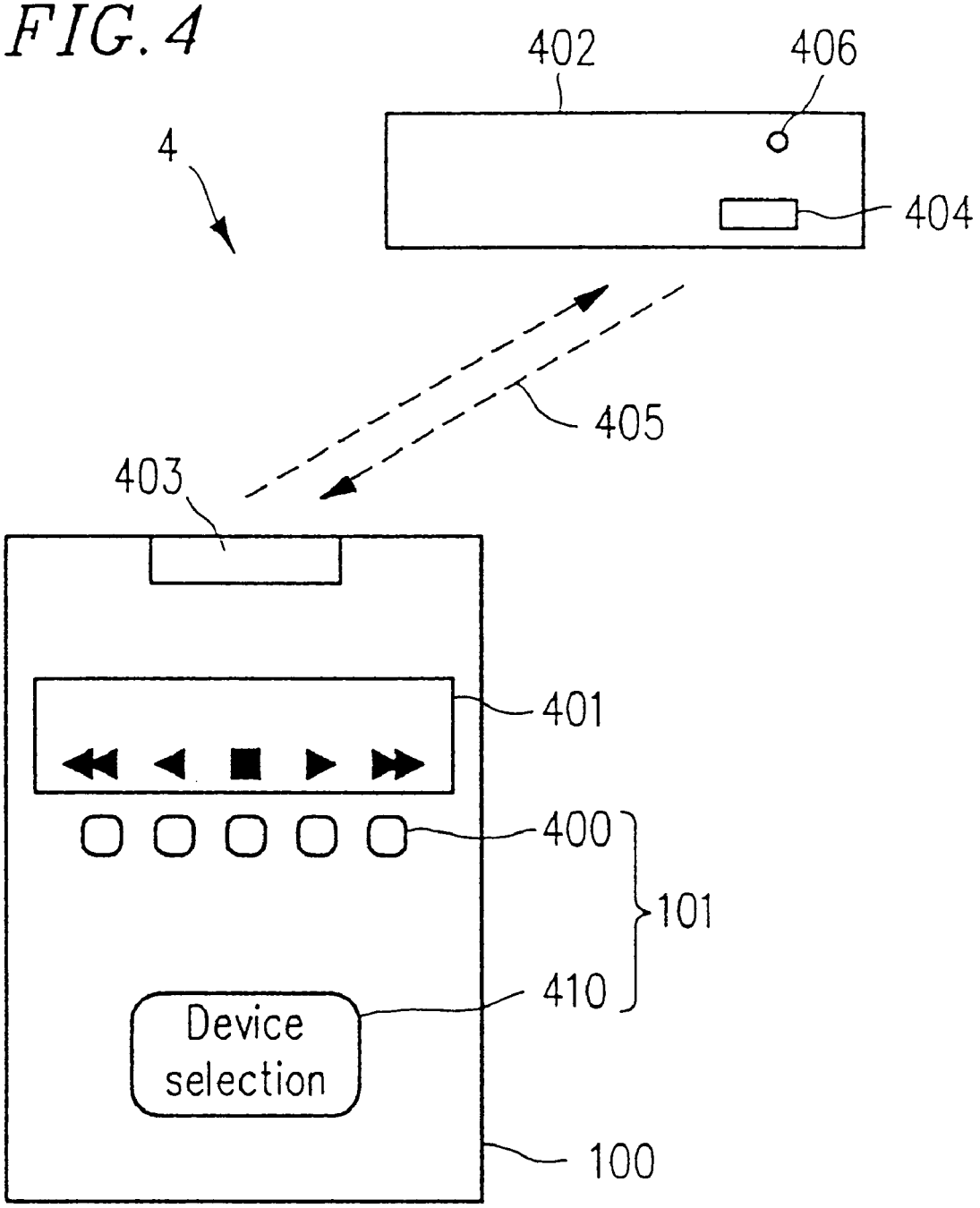
FIG. 4 is a view schematically illustrating the appearance of a remote control system is a fourth example according to the present invention.

FIG. 4 is a view schematically illustrating the appearance of a remote control system 4 in a fourth example according to the present invention.

The remote controller 100 in the remote control system 4 includes the operation key section 101 having a selection key 410 and function keys 400. A display 401 for displaying the function corresponding to each function key 400 is provided in the vicinity of the function keys 400. The display 401 can change what is displayed in accordance with the settings regarding the electronic device. For example, when an electronic device 402 to be controlled is a VCR, the display 401 symbolically shows functions of the VCR (play, fast forward, rewind or the like). Data transmission between the remote controller 100 and the electronic device 402 including the remote control interface (indicated by reference numeral 109 in FIG. 5) is performed by transmission of infrared light 405 between a receiver 403 of the remote controller 100 and a receiver 404 of the electronic device 402. The electronic device 402 further includes a display element 406 (for example, an LED) which shows the user that a trigger signal has been received.

Figure 5:
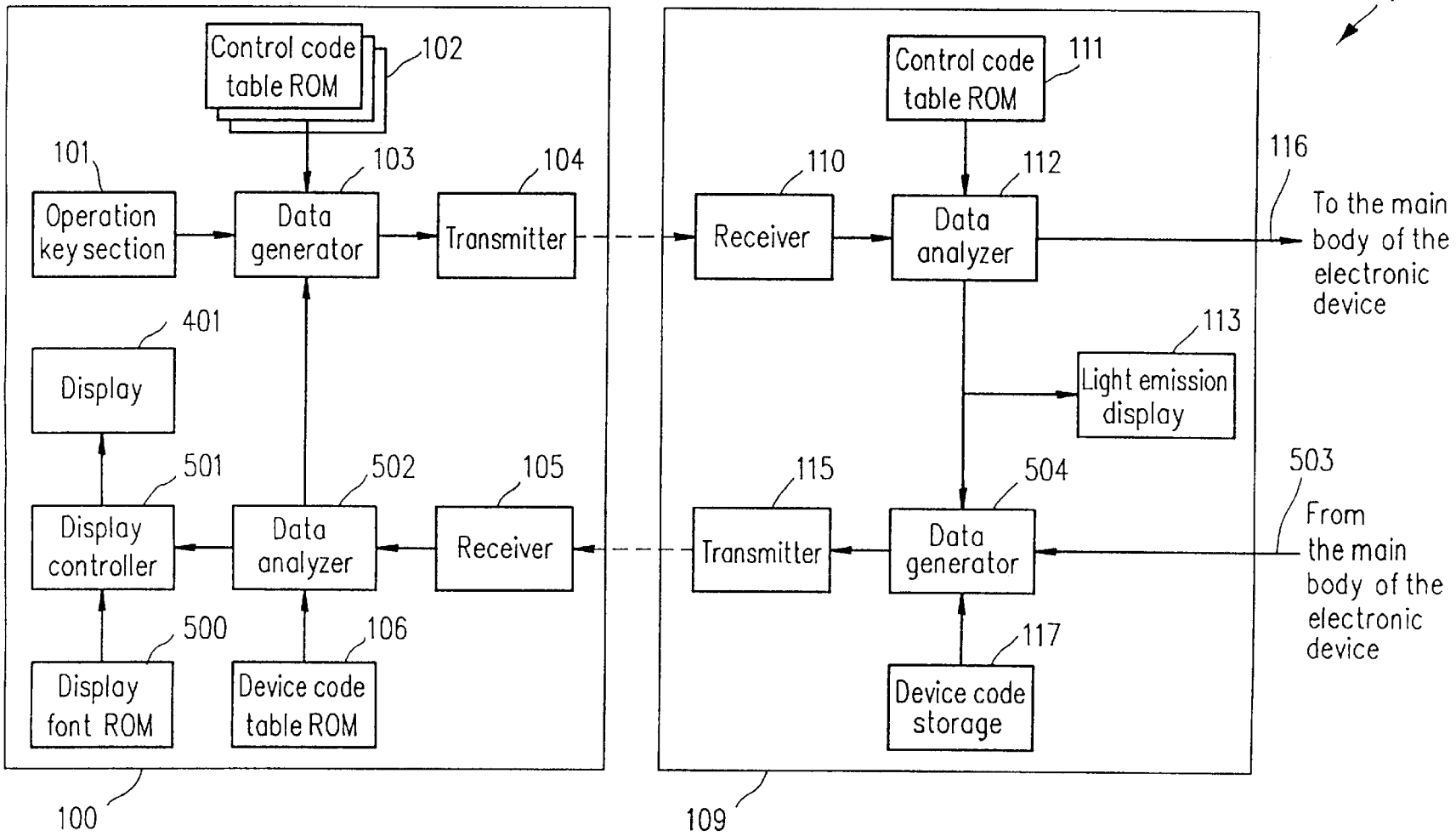
FIG. 5 is a block diagram of a remote control system in the fourth example according to the present invention.

FIG. 5 is a block diagram of the remote control system 4. The remote control system 4 operates in the following manner.

When the user presses the selection key in the operation key section 101, the operation key section 101 sends data indicating the selection key has been pressed to the data generator 103. Upon receipt of the data, the data generator 103 generates and sends trigger data to the transmitter 104. The transmitter 104 modulates infrared light by the trigger data and transmits the trigger signal to the remote control interface 109.

Upon receipt of the trigger signal, the receiver 110 (corresponding to the receiver 404 in FIG. 4) in the remote control interface 109 demodulates the trigger signal to restore the trigger data and sends the data to the data analyzer 112. The data analyzer 112 commands the light emission display 113 to turn on the LED (corresponding to the display element 406 in FIG. 4) to show the user that the trigger signal has been received. The electronic device 402 supplies the remote control interface 109 with font data 503 indicating fonts to be displayed in accordance with the type and the functions of the electronic device 402. In this specification, "font" includes symbols and graphic as well as letters. The remote control interface 109 sends the font data 503 to the remote controller 100 together with the device code in the form of infrared light.

Then, the receiver 105 (corresponding to the receiver 403 in FIG. 4) in the remote controller 100 demodulates the infrared light to restore and sends the device code and the font data 503 to a data analyzer 502. The data analyzer 502 sends the control code to the data generator 103 and sends the font data 503 to a display controller 501. The display controller 501 controls the display 401 to display the font based on the data stored in a display font ROM 500 and the font data 503. The data indicating the font to be displayed is stored in the ROM in this example, but can be stored in any type of device which can store such data. The font data 503 is, for example, an address in the display font ROM 500, the address storing the bit map data. The bit map data indicates the brightness of the pixel forming each of a plurality of fonts. For example, in the case where one font is displayed in a monochrome state by 16 pixels×16 pixels, one font can be displayed by 256-bit data. In this case, the display controller 501 retrieves the bit map data from the address in the display font ROM 500, the address being indicated by the font data 503, and sends the bit map data to the display 401. The display 401 displays the font based on the bit map data. As the display 401, a liquid crystal panel, a dot matrix LED panel or the like is appropriately used.

The letters and graphics in the display 401 indicate information which the electronic device 402 should show the user, for example, the functions corresponding to the function keys 400. For example, letters which show the user that the VCR is in the timer recording state can be displayed as necessary. Thus, the user can activate a desired function of the electronic device 402, referring to the information in the display 401 after selecting the electronic device 402.

The font data 503 indicates the font to be displayed in this example, but can indicate other information. For example, the font data 503 can indicate the operation mode of the electronic device 402; namely, that the VCR is in the "play" state, or that the VCR is in the "standby" state for timer recording. In such a case, the display controller 501 controls the display 401 to show necessary information in accordance with the operation mode indicated by the font data 503.

Figure 6A:
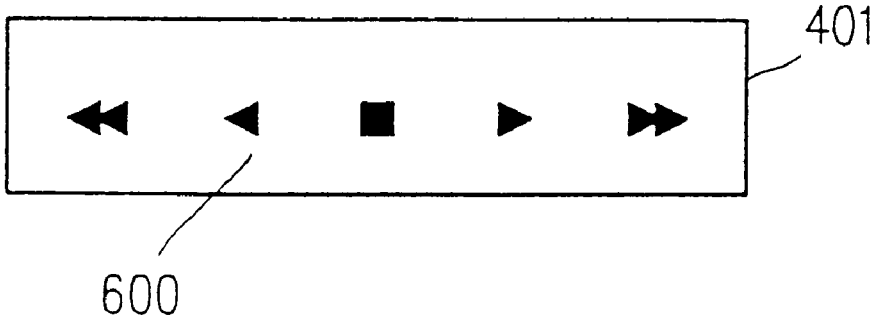
FIGS. 6A and 6B are view illustrating examples of a display of the remote control system in the fourth example.
Figure 6B:
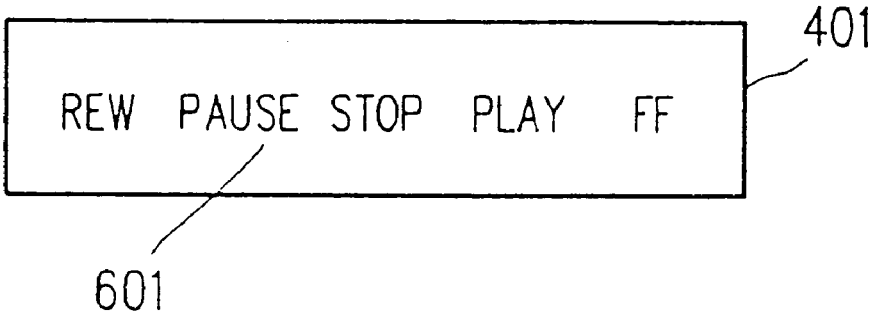

FIGS. 6A and 6B are views illustrating examples of what can be shown in the display 401. The contents in the display 401 can be arbitrarily changed in accordance with the functions and the operation mode of the electronic device 402 and the display performance of the remote controller 100. The contents of the display 401 can be, for example, symbols 600 (FIG. 6A) or letters 601 (FIG. 6B).

As is described above, the remote control system 4 in the fourth example can change the functions shown in the display 401 corresponding to the function keys 400 in accordance with the data sent from the electronic device 402. By such a structure, functions of various types of electronic devices can be displayed. Thus, the remote control system 4 can be used for controlling various types of electronic devices even when having a limited number of function keys.

EXAMPLE 5

Figure 7:
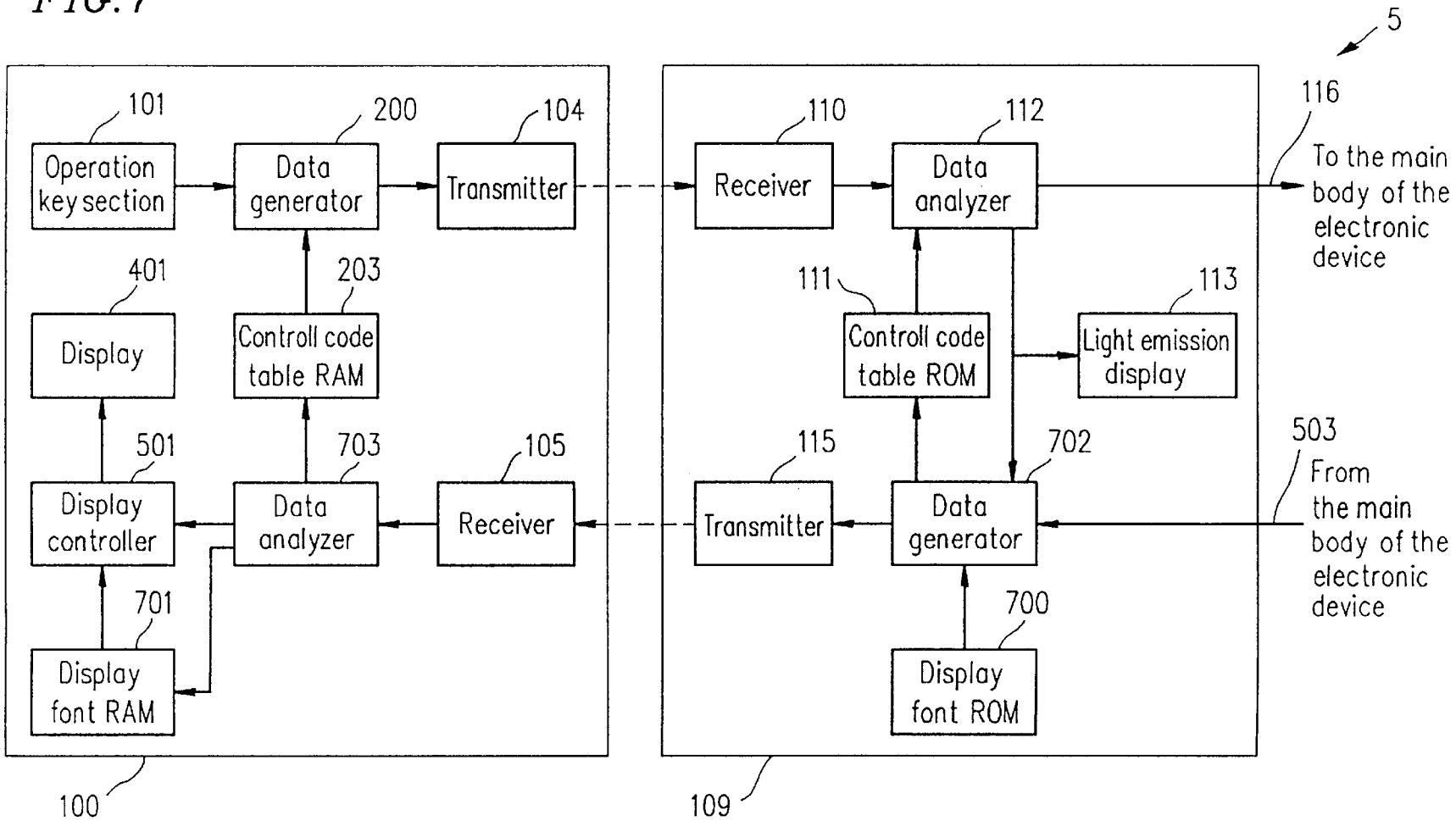
FIG. 7 is a block diagram of a remote control system in a fifth example according to the present invention.

FIG. 7 is a block diagram of a remote control system 5 in a fifth example according to the present invention. In the fourth example, the remote controller 100 includes the display font ROM 500 in the remote control system 4; whereas in the fifth example, the remote control interface 109 includes a display font ROM 700 in the remote control system 5. The remote controller 100 includes a display font RAM 701 for storing bit map data stored in the display font ROM 700. The bit map data is stored in the RAM in this example, but can be stored in any type of device which can store such data.

When the user presses the selection key in the operation key section 101, a trigger signal is sent to the remote control interface 109 in the same manner as in the previous examples. Upon receipt of the trigger signal, the receiver 110 sends the trigger signal to the data analyzer 112 as in the same manner as in the previous examples. The data analyzer 112 commands a data generator 702 to transmit the font data 503 from the electronic device and the bit map data from the display font ROM 700 to the remote controller 100 as a response signal. The font data 503 includes, for example, a code of the font to be shown in the display 401. In order to display a font, bit map data corresponding to the code of the font is required. Upon receipt of the font data 503 and the bit map data, the data generator 702 integrates the two types of data into one data stream and sends the data stream to the transmitter 115. The transmitter 115 transmits the data stream to the remote controller 100 as a response signal.

The receiver 105 in the remote controller 100 restores the font data 503 and the bit map data from the response signal and sends the two types of data to a data analyzer 703. The data analyzer 703 sends the font data 503 to the display controller 501 and sends the bit map data to the display font RAM 701. The display font RAM 701 then stores the bit map data. When the display controller 501 designates an address storing the bit map data of the data to be displayed, the display font RAM 701 sends the bit map data stored in the designated address to the display controller 501. The display controller 501 then sends the bit map data to the display 401. The display 401 displays the font corresponding to the bit map data. The display 401 can be, for example, a liquid crystal panel or a dot matrix LED panel.

In the remote control system 5 in the fifth example, since the bit map data of the font to be displayed is stored in the remote control interface 109, the remote controller 100 need not have a ROM for storing the bit map data. Accordingly, a small-capacity rewritable memory is sufficient for the remote controller 100. By transmitting bit map data of the font to be displayed from the remote control interface 109 of the electronic device to the remote controller 100, suitable display for the selected electronic device and functions thereof can be performed using a small-capacity memory.

The font data 503 can indicate operation modes of the electronic device. In this case, the display font ROM 700 stores display data corresponding to each of the operation modes as, for example, bit map data. The remote controller 100 displays appropriate information in the display 401 in correspondence with the operation mode, using the bit map data. For example, when the electronic device is a VCR, the gain of the equalizer is shown in a bar graph in the sound quality adjustment mode and set time is shown in the timer setting mode.

EXAMPLE 6

Figure 8:
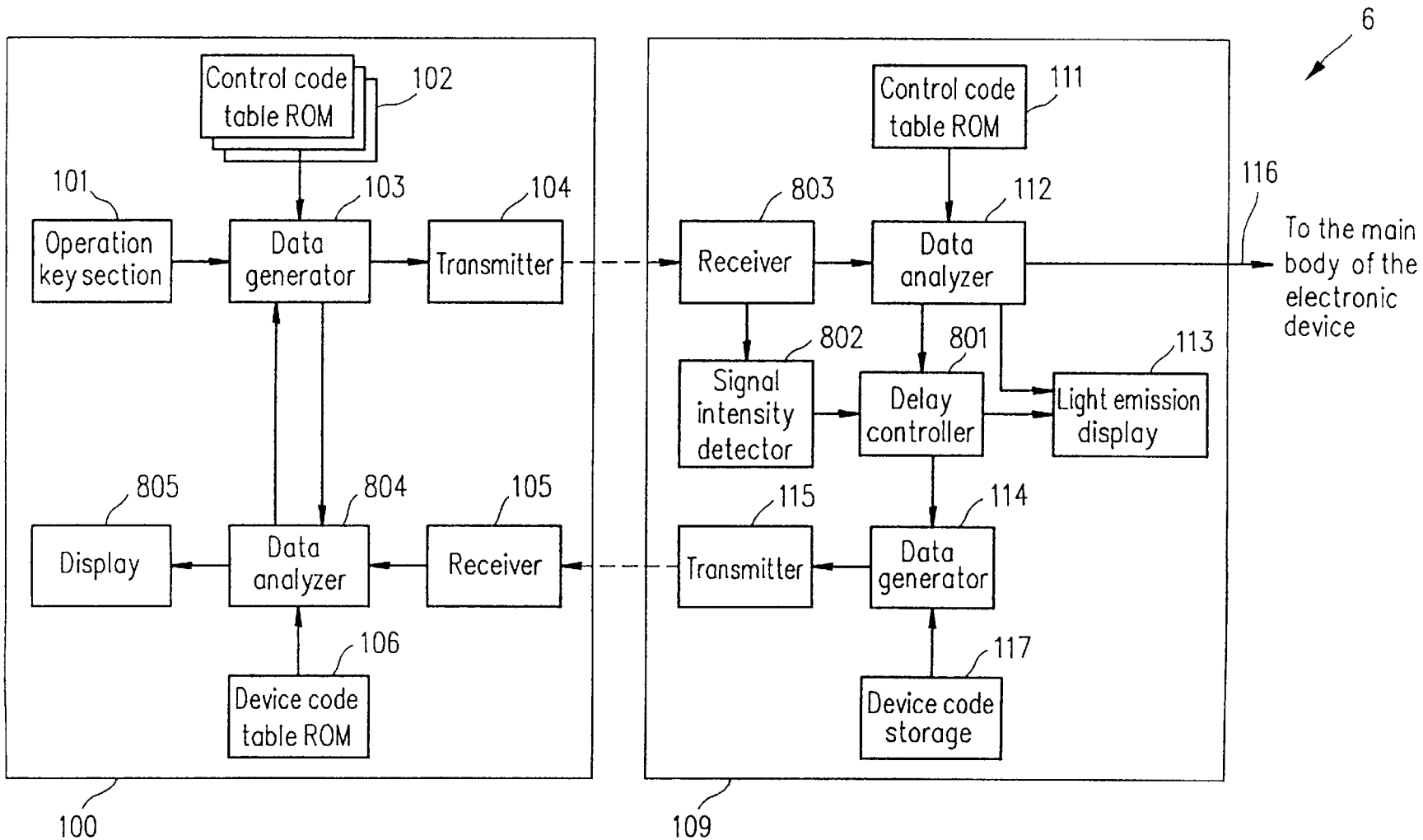
FIG. 8 is a block diagram of a remote control system in a sixth example according to the present invention.

FIG. 8 is a block diagram of a remote control system 6 in a sixth example according to the present invention. The remote control system 6 has an identical structure with that of the remote control system 1 in the first example except for a delay controller 801, a signal intensity detector 802, and a receiver 803 in the remote control interface 109 and a data analyzer 804 and a display 805 in the remote controller 100.

When the user presses the selection key in the operation key section 101, a trigger signal is sent to the remote control interface 109 in the same manner as in the previous examples. Upon receipt of the trigger signal, the receiver 803 in the remote control interface 109 sends the trigger signal to the data analyzer 112 as in the same manner as in the previous examples. Simultaneously, the receiver 803 sends an output signal from a light receiving element (for example, a photodiode) in the receiver 803 to the signal intensity detector 802. The signal intensity detector 802 sends an intensity signal corresponding to the intensity of infrared light used as a carrier wave to the delay controller 801. The intensity signal is obtained by, for example, finding an average value of the amplitude of the infrared light which is not modulated by data.

The delay controller 801 commands the data generator 114 to transmit a device code when the delay time corresponding to the intensity signal has passed after being commanded by the data analyzer 112 to transmit the device code. The delay time is in proportion to the intensity of the infrared light. Thus, in the case where the intensity of the trigger signal from the remote controller 100 is relatively high, the device code is transmitted from the remote control interface 109 as a response signal when a relatively short period of time has passed after the command from the data analyzer 112. In the case where the intensity of the trigger signal from the remote controller 100 is relatively low, the device code is transmitted from the remote control interface 109 as a response signal when a relatively long period of time has passed after the command from the data analyzer 112.

The data analyzer 804 in the remote controller 100 measures the time period from the time when the trigger signal is sent until when the response signal is received. Such a time period depends on the delay time. If such a time period is relatively short, the intensity of the trigger signal is relatively high; whereas if such a time period is relatively long, the intensity of the trigger signal is relatively low.

Even if a plurality of remote control interfaces 109 each send a response signal to the trigger signal, the plurality of response signals are received with different delay times since the trigger signals have different intensities. Accordingly, the remote controller 100 can receive a plurality of response signal arriving at different times.

Upon receiving the plurality of response signals, namely, a plurality of device codes, the data analyzer 804 generates data indicating the type of each of the electronic devices using the corresponding device code. The data analyzer 804 then sends the data indicating the type of each electronic device to the display 805 in the order activating from the data corresponding to the signal having the shortest delay time. The display 805 shows the type of the electronic device from the top line (not shown) in the same order. In other words, the electronic device listed on the top line of the display 805 receives the trigger signal with the highest intensity. For example, if "VCR" is listed on the top line and "TV" is listed on the second line, the intensity of the trigger signal received by the VCR is higher than the intensity of the trigger signal received by the TV. In this manner, the user can learn the types of the electronic devices on the display 805 in the order of the intensity of the response signal even if a plurality of response signals are sent back. The user can then select one of the electronic devices using some of the keys in the operation key section 101. The data generator 103 transmits a control signal using the control code table corresponding to the selected electronic device. If the data is input after a prescribed period of time, the information on the display 805 is cleared and the types of the electronic devices are listed from the top line again.

In the remote control system 6 in the sixth example, even if a plurality of electronic devices are located close to one another, the remote controller 100 can distinguish the response signals from different electronic devices because the electronic devices transmit the response signals at different timing. Further, since the user can check which electronic devices have sent the response signals on the display 805, the intention of the user can be accurately reflected.

In the first through sixth examples, data transmission can be performed using an electronic wave as a carrier instead of infrared light.

In the fourth and fifth examples, letters and graphics are displayed using bit map data. According to the present invention, simpler display methods can be used. For example, several LEDs can be turned on and off to give the user necessary information.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A remote controller for controlling a selected electronic device having stored therein a device code which specifically identifies the type of the selected electronic device, comprising:

a memory for storing a plurality of control codes for each of a plurality of different types of electronic devices, wherein the plurality of control codes for a corresponding type of electronic device are employable by the remote controller to activate corresponding operational functions in the corresponding type of electronic device;

a trigger signal transmitter for transmitting a trigger signal for causing the selected electronic device to transmit a response signal containing the device code;

a receiver for receiving the response signal; and a control signal transmitter for selecting control codes from among the plurality of control codes stored in the memory based on the identity of the type of the selected electronic device as determined automatically from the device code contained in the received response signal, generating control signals based on the selected control codes, and transmitting the generated control signals to the selected electronic device to activate the corresponding operational functions in the selected electronic device.

2. A remote controller according to claim 1, wherein:

the trigger signal transmitter includes an element for transmitting light indicating the trigger signal in a first condition, the control signal transmitter includes an element for transmitting light indicating the control signal in a second condition, and the first condition is different from the second condition so as to represent different wireless transmission characteristics.

3. A remote controller according to claim 2, wherein the light indicating the trigger signal is transmitted with a narrow directivity than the light indicating the control signal.

4. A remote controller according to claim 1, wherein:

the response signal includes data indicating an operation mode of the electronic device, the remote controller further including:

a memory for storing a plurality of display data each indicating the relationship between a plurality of operation modes and graphic characters to be displayed in correspondence with the operation modes; and a graphic display for selecting one of the plurality of display data based on the data indicating the operation mode included in the response signal and displaying one of the graphic characters based on the selected display data.

5. A remote controller according to claim 1, wherein:

the response signal includes data indicating an operation mode of the electronic device and a plurality of display data each indicating the relationship between a plurality of operation modes and graphic characters to be displayed in correspondence with the operation modes, the remote controller further including:

a memory for storing the plurality of display data retrieved from the response signal; and a graphic display for displaying one of the graphic characters based on the display data and the data indicating the operation mode.

6. A remote controller according to claim 5, further comprising an element indicating that the received signal is a trigger signal.

7. A remote controller according to claim 1, further comprising an element indicating operationally successful receipt of the response signal.

8. A remote controller for controlling an electronic device having stored therein a plurality of control codes which are employable by the remote controller for activating corresponding operational functions in the electronic device, comprising:

a trigger signal transmitter for transmitting a trigger signal for causing the electronic device to transmit a response signal which includes a plurality of control codes which are employable by the remote controller to activate corresponding operational functions in the electronic device;

a receiver for receiving the response signal;

a memory for storing the plurality of control codes retrieved from the response signal;

a data generator for selectively retrieving a control code from among the plurality of control codes having been stored in the memory; and a control signal transmitter for modulating the control code retrieved by the data generator to generate a control signal, and transmitting the generated control signal to the electronic device to activate a corresponding operational function in the electronic device.

9. A remote control interface for receiving a control signal transmitted from a remote controller and transmitting the control signal to an electronic device, the remote control interface comprising:

a receiver for receiving a signal transmitted from the remote controller;

a signal generator having stored therein a device code which specifically identifies the type of the electronic device for generating a response signal containing the device code; and a transmitter for, when the signal is a control signal, transmitting the control signal to the electronic device in order that the control signal activates a corresponding operational function of the electronic device, and for, when the signal is a trigger signal demanding the response signal, automatically transmitting the response signal to the remote controller whereby the response signal is operative to identify from the device code for the remote controller the specific type of the electronic device.

10. A remote control interface according to claim 9, wherein the response signal includes data indicating an operation mode of the electronic device.

11. A remote control interface according to claim 9, wherein the response signal includes a plurality of display data each indicating the relationship between a plurality of operation modes and graphic characters to be displayed in correspondence with the operation modes.

12. A remote control interface for receiving a control signal transmitted from a remote controller and transmitting a control code included in the control signal to an electronic device, the remote control interface comprising:

a receiver for receiving a signal transmitted from the remote controller;

a memory having stored therein a plurality of control codes employable by the remote controller to activate corresponding operational functions in the electronic device;

a transmitter for, when the signal is a control signal, transmitting a control code included in the control signal to the electronic device in order that the control code activates a corresponding operational function of the electronic device, and for, when the signal is a trigger signal requesting the plurality of control codes, transmitting a response signal including the plurality of control codes stored in the memory to the remote controller for use in generating the control signals by modulating the control codes.

13. A remote control system for controlling an electronic device including a remote controller and a remote control interface, wherein:

the remote controller includes:

a memory for storing a plurality of control codes for each of a plurality of different types of electronic devices, wherein the plurality of control codes for a corresponding type of electronic device are employable by the remote controller to activate corresponding operational functions in the corresponding type of electronic device;

a trigger signal transmitter for transmitting a trigger signal for causing the remote control interface to transmit a response signal containing a device code which specifically identifies the type of the electronic device;

a receiver for receiving the response signal; and a control signal transmitter for selecting control codes from among the plurality of control codes stored in the memory based on the identity of the type of the electronic device as determined automatically from the device code contained in the received response signal, generating control signals based on the selected control codes, and transmitting the generated control signals to the remote control interface in order to activate the corresponding operational functions in the electronic device, and the remote control interface includes:

a receiver for receiving a signal transmitted from the remote controller;

a signal generator having stored therein the device code for generating the response signal; and a transmitter for, when the signal is a control signal, transmitting the control signal to the electronic device in order that the control signal activates a corresponding operational function of the electronic device, and for, when the signal is a trigger signal demanding the response signal, transmitting the response signal to the remote controller whereby the response signal is operative to identify from the device code for the remote controller the specific type of the electronic device.

14. A remote control system for controlling an electronic device including a remote controller and a remote control interface, wherein:

the remote controller includes:

a trigger signal transmitter for transmitting a trigger signal for causing the remote control interface to transmit a response signal which includes a plurality of control codes which are employable by the remote controller to activate corresponding operational functions in the electronic device;

a receiver for receiving the response signal;

a first memory for storing the plurality of control codes retrieved from the response signal;

a data generator for selectively retrieving a control code from among the plurality of control codes having been stored in the first memory; and a control signal transmitter for modulating the control code retrieved by the data generator to generate a control signal, and transmitting the generated control signal to the remote control interface to activate a corresponding operational function in the electronic device, and the remote control interface includes:

a receiver for receiving a signal transmitted from the remote controller;

a second memory having stored therein the plurality of control codes; and a transmitter for, when the signal is the control signal, transmitting the control code included in the control signal to the electronic device in order that the control code activates the corresponding operational function of the electronic device, and for, when the signal is a trigger signal requesting the plurality of control codes, transmitting the response signal including the plurality of control codes stored in the second memory to the remote controller.

* * * * *